US007149153B2

(12) United States Patent
Meylan

(10) Patent No.: US 7,149,153 B2
(45) Date of Patent: Dec. 12, 2006

(54) WATCH WHOSE CASE INCLUDES A BACK COVER OR COVER WITH A BAYONET FITTING FOR MANUAL OPENING

(75) Inventor: Frédéric Meylan, Neuchâtel (CH)

(73) Assignee: Asulab S.A., Marin (CH)

( * ) Notice: Subject to any disclaimer, the term of this patent is extended or adjusted under 35 U.S.C. 154(b) by 347 days.

(21) Appl. No.: 10/733,518

(22) Filed: Dec. 12, 2003

(65) Prior Publication Data

US 2004/0120224 A1 Jun. 24, 2004

(30) Foreign Application Priority Data

Dec. 23, 2002 (EP) ..... 02080668

(51) Int. Cl.
*G04B 37/11* (2006.01)

(52) U.S. Cl. ..... 368/88; 368/291

(58) Field of Classification Search ..... 368/88, 368/149, 291, 280, 255
See application file for complete search history.

(56) References Cited

U.S. PATENT DOCUMENTS

| | | | | |
|---|---|---|---|---|
| 4,073,132 | A | 2/1978 | Frohlich | |
| 4,206,590 | A | 6/1980 | Fukutome et al. | |
| 4,796,240 | A * | 1/1989 | Stevens | 368/281 |
| 6,219,304 | B1 * | 4/2001 | Mignot et al. | 368/88 |
| 6,418,086 | B1 * | 7/2002 | Terasawa et al. | 368/88 |
| 2002/0064908 | A1 | 5/2002 | Marquis et al. | |
| 2002/0096544 | A1 | 7/2002 | Scarinzi et al. | |

FOREIGN PATENT DOCUMENTS

| | | |
|---|---|---|
| CH | 211 142 | 8/1940 |
| DE | 10 24 889 | 2/1958 |
| EP | 272 515 A1 | 12/1987 |
| GB | 1 565 930 | 4/1980 |

* cited by examiner

*Primary Examiner*—Kammie Cuneo
*Assistant Examiner*—Jeanne-Marguerite Goodwin
(74) *Attorney, Agent, or Firm*—Sughrue Mion, PLLC

(57) ABSTRACT

In an electronic watch containing an electric battery assembly of large size, particularly a battery assembly including several batteries or accumulators (41, 42), the diameter of a removable cover (20) closing a large bottom opening of the back cover (14) of the watchcase is limited by the fact that the cover is provided with a bayonet fitting device having locking members (56) radially directed towards the interior. These locking members catch on a fixed support (22) having one or more housings for the battery assembly. They are arranged at the top of a substantially cylindrical annular portion (50) of the cover. A sealing gasket (52) is placed around this annular portion and compressed radially against a cylindrical surface (16) of the periphery of the opening in the back cover, which ensures water-resistance even if the bayonet fitting is not screwed all the way in. According to a variant, the cover can form the entire back cover of the case.

11 Claims, 4 Drawing Sheets

WATCH WHOSE CASE INCLUDES A BACK COVER OR COVER WITH A BAYONET FITTING FOR MANUAL OPENING

BACKGROUND OF THE INVENTION

The present invention concerns a watch having a case that contains an electronic watch movement and an electric battery assembly including at least one battery or at least one accumulator, the case having a circular bottom opening which allows the battery to be inserted and removed and which is closed in a water-resistant manner by a removable cover provided with bayonet fitting means, the cover including a plate, which covers a housing for the battery and forms at least one part of the back cover of the case, and a substantially annular cylindrical portion, which extends perpendicularly to said case and fits into said opening, said annular portion carrying at least two locking members forming part of the bayonet fitting means.

The removable cover that closes the hatch giving access to the battery assembly can either itself constitute the back cover of the watchcase, or close the opening arranged in a back cover that is itself fixed to the middle part of the case or made in a single piece with said middle part.

The expression "electric battery assembly" here means a source of electric energy, which can include one or more single use batteries, or one or more rechargeable accumulators.

The invention applies particularly, but not exclusively, to electronic watches including one or more additional devices, which consume electric energy, such as for example a device for communication via radio, optical or acoustic transmission, a measuring device using a pressure or other type of sensor, a navigation device, an electronic camera, an electronic diary, etc. In many cases, the energy consumption of these additional devices requires the inclusion in the watch of quite a large electric battery assembly, including either several batteries or accumulators, or a large sized battery assembly or accumulator. The opening necessary in the back cover of the case to give access to the battery assembly can then become very large and extend over most, or all of the surface of the back cover. When the removable cover closing this opening is fixed by a bayonet fitting, the space requirement of the elements of this system and the associated sealing members can cause problems.

EP Patent Application No. 272 515 discloses a wristwatch of the type indicated in the preamble hereinbefore and having a large cover at the back for giving access to the electric battery assembly. In order to allow a reduction in the thickness of the watch, the circular opening of the back cover of the case has a substantially larger diameter than the diameter of the circle circumscribed about the assembly formed by the watch movement and the battery assembly. The bayonet fitting means are arranged outside this circle, at a level located above the bottom face of the movement. The cylindrical annular part of the cover is used to reinforce the latter and to carry at its top the locking members of the bayonet fitting device, which are directed towards the exterior in order to be able to be hooked onto the inner edges of the middle part of the case. Water-resistance around the opening is achieved in a conventional manner, by means of an O-ring joint arranged in a groove of the bottom face of the middle part and compressed axially by the cover.

When the electric battery assembly of the watch has to have a relatively large size in a plane, this design has the drawback of requiring a much larger opening, in order to allow the locking members of the cover to pass between the periphery of the opening and the circle circumscribed about the battery assembly. Moreover, given that the sealing gasket has to have a larger diameter than the opening, the external diameter of the cover is further increased. The large size of the battery assembly thus leads to a very wide watchcase. Another drawback is that if the user has not rotated the cover right in to secure it, water-resistance is not guaranteed since the axial compression of the sealing gasket is likely to be insufficient. The cover has to compress the sealing gasket quite strongly, which involves significant stress on the bayonet fitting locking members.

SUMMARY OF THE INVENTION

The present invention concerns a watch arranged so as to largely avoid the aforementioned drawbacks, particularly in order to be able to limit the size of the cover with respect to the circle circumscribed about the battery assembly when the latter is particularly cumbersome, for example when it includes several batteries or accumulators.

Thus, there is provided a watch of the type indicated in the preamble wherein a support fixedly mounted in the case extends at least partially opposite said opening and wherein said cover locking members extend towards the inside of the substantially cylindrical annular portion of the cover and are caught on shoulders of the support. Consequently, said shoulders are inside said annular portion when the cover is secured to the case.

This simple idea leads to a substantial saving on the diameter of the opening and the minimum plane dimension of the cover, particularly when the battery assembly is not circular, because the space occupied inside the case by the locking members of the bayonet fitting system, which cover only a restricted arc length around the battery assembly, can be located in free zones between the battery assembly and the circle circumscribed about said battery assembly. Thus, the minimum radial gap between said circle and the periphery of the opening is reduced only because it is dictated by the thickness of the cylindrical annular portion of the cover and the small play necessary around the latter, but not by the size of the locking members. The support can advantageously be a battery support, made of insulating material and provided with one or more housings for the batteries.

Moreover, the arrangement of the locking members towards the inside of the annular portion of the cover advantageously allows the sealing gasket to be arranged around said annular portion, so that the sealing gasket is pressed radially against a circular surface forming the periphery of said opening, particularly a substantially cylindrical surface. The opening can also have a flared entrance to ensure radial compression of the sealing gasket when the cover is being set in place. This arrangement of the sealing gasket takes very little place in the radial direction and thus allows the width of the cover to be considerably reduced with respect to the aforecited prior art. Owing to the radial compression of the sealing gasket, water-resistance is guaranteed even if the cover was not rotated right in when it was set in place, and further, the compression of the sealing gasket involves practically no additional stress on the locking members.

Preferably, gripping means are arranged on a peripheral portion of the cover so as to allow a user to handle the cover manually without any specific tools.

Other features and advantages of the present invention will appear in the following description of various embodiments, given by way of non-limiting examples with reference to the annexed drawings.

DETAILED DESCRIPTION OF THE INVENTION

Figure 1:
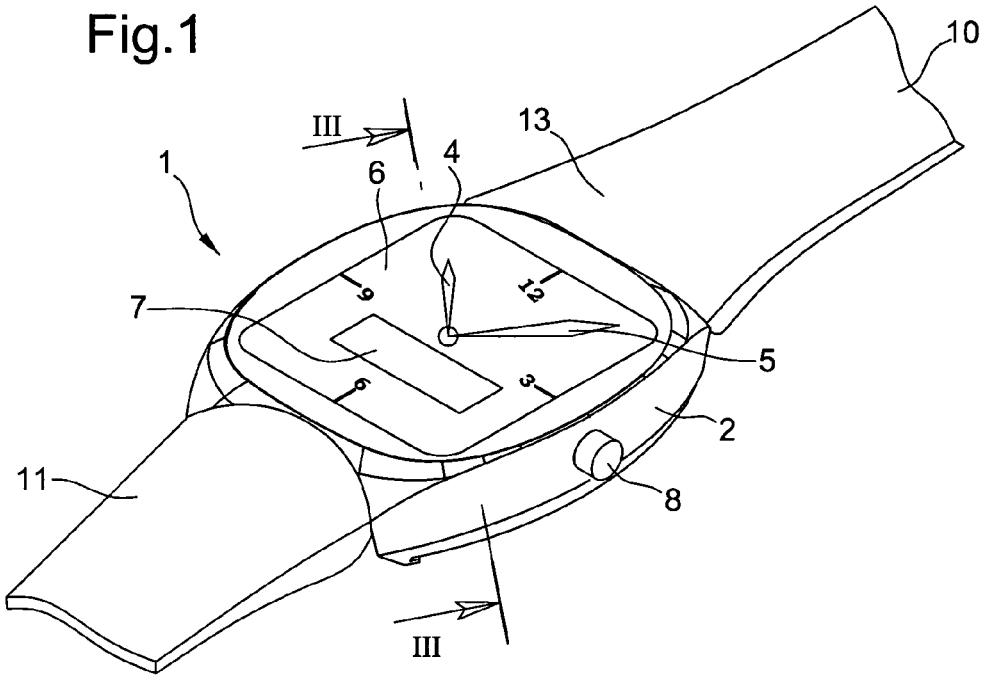
FIG. 1 is a perspective view of a first embodiment of a wristwatch according to the principles of the present invention.

FIG. 1 shows in perspective a wristwatch 1 including case 2 of non-circular shape, closed above by a glass 6 arranged above a dial for an analogue time display by means of hands 4 and 5 driven by an electronic watch movement. The dial can also include an aperture for a digital or alphanumerical display 7. One or more control members 8 are arranged on the case. The wristwatch can be attached to the wrist by means of two wristband strands 10 and 11 secured to the middle part of case 2 and fastened by a known type of clasp.

Figure 2:
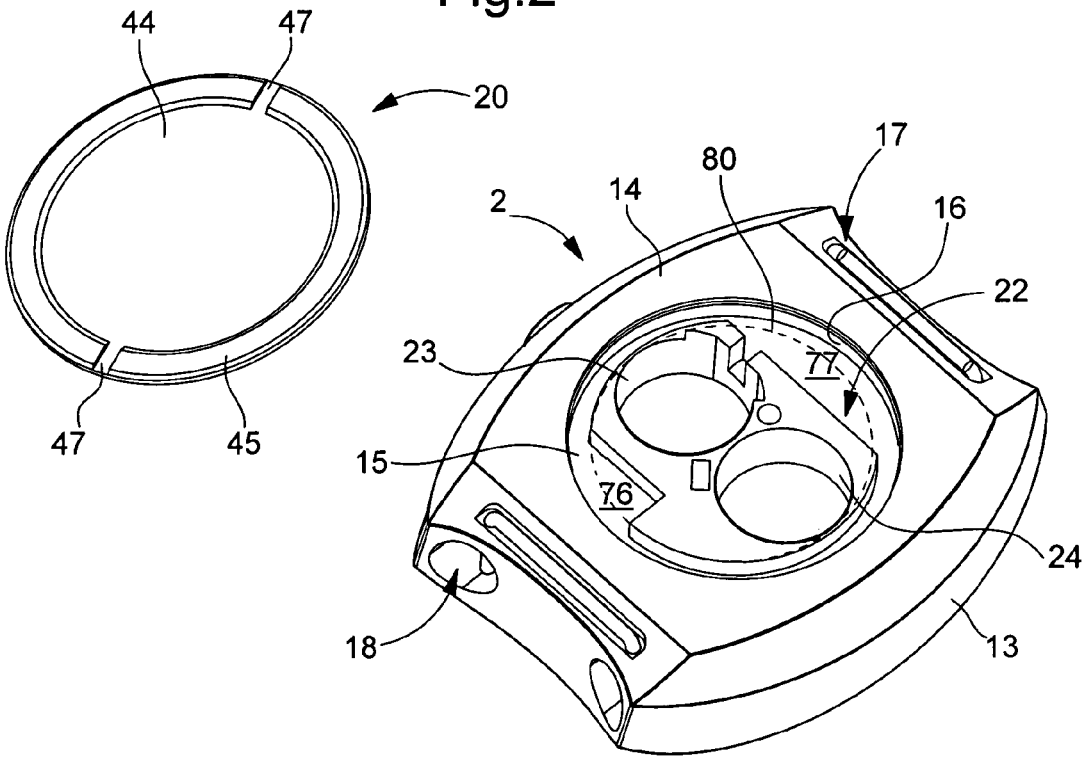
FIG. 2 is a perspective bottom view of the watchcase of FIG. 1, where the cover closing the opening of the bottom face has been removed.

FIG. 2 shows more particularly the underneath of watchcase 2. In the present example, the watchcase is made of a single-block construction including a middle part 13 and a back cover 14, in which a circular opening 15 is arranged, acting as an access hatch for the electric battery (not shown in this Figure). The peripheral wall of opening 15 includes a substantially cylindrical circular surface 16. The back cover-middle part of watchcase 2 is fitted with fastening members 17 and 18 for securing them to wristband strands 10 and 11.

Normally, opening 15 is closed in a water-resistant manner by a removable circular cover 20, which, in the view of FIG. 2, has been removed to show a battery support 22 fixedly mounted inside case 2. When it is set in place in opening 15, cover 20 is fixed to support 22 by a bayonet fitting type device, which will be described in detail hereinafter. In this example, support 22 includes two circular housings 23 and 24 for two batteries together forming the electric battery assembly for powering the circuits contained in the watch. In this example, the case and the cover are preferably metallic, but other materials can be envisaged.

Figure 3:
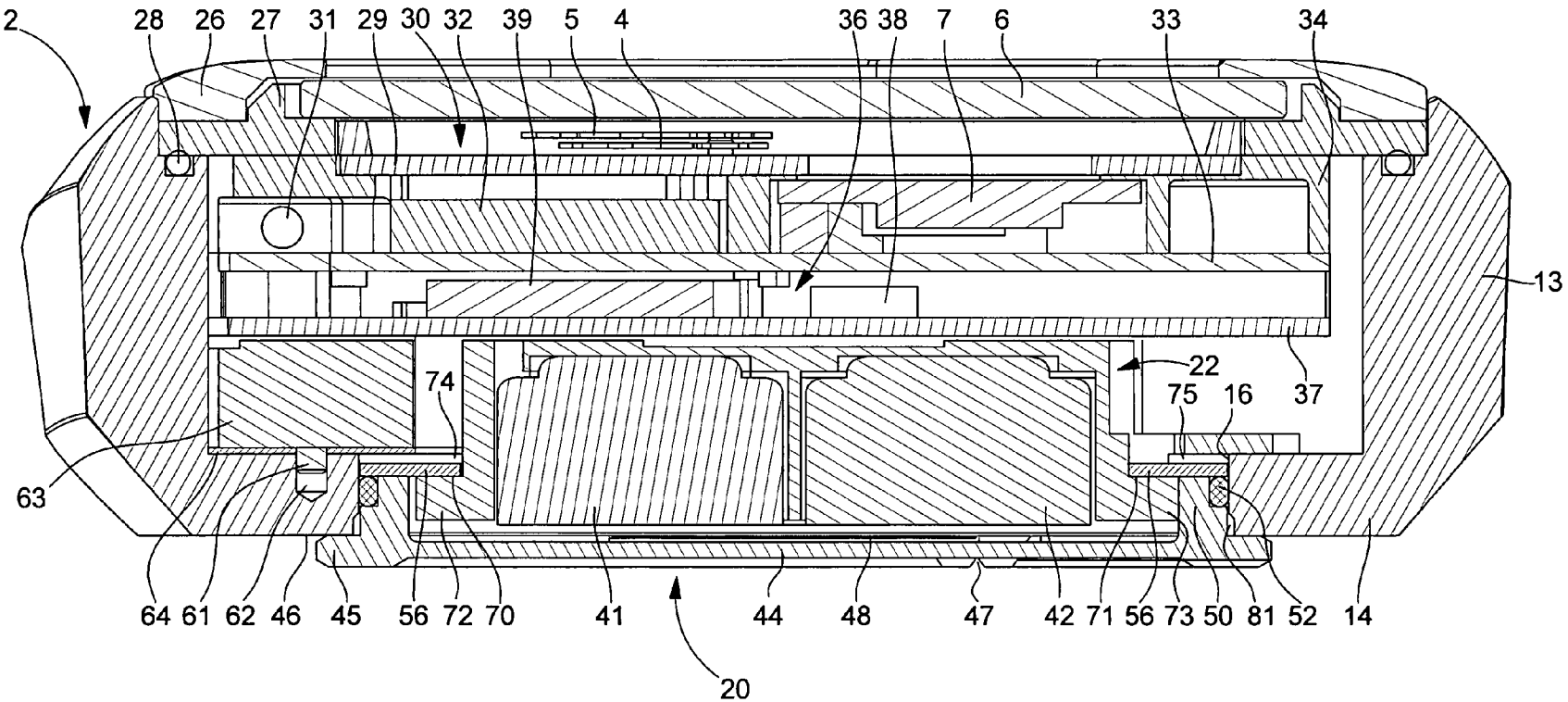
FIG. 3 is a cross-section of the watch along the line III—III of FIG. 1.
Figure 4:
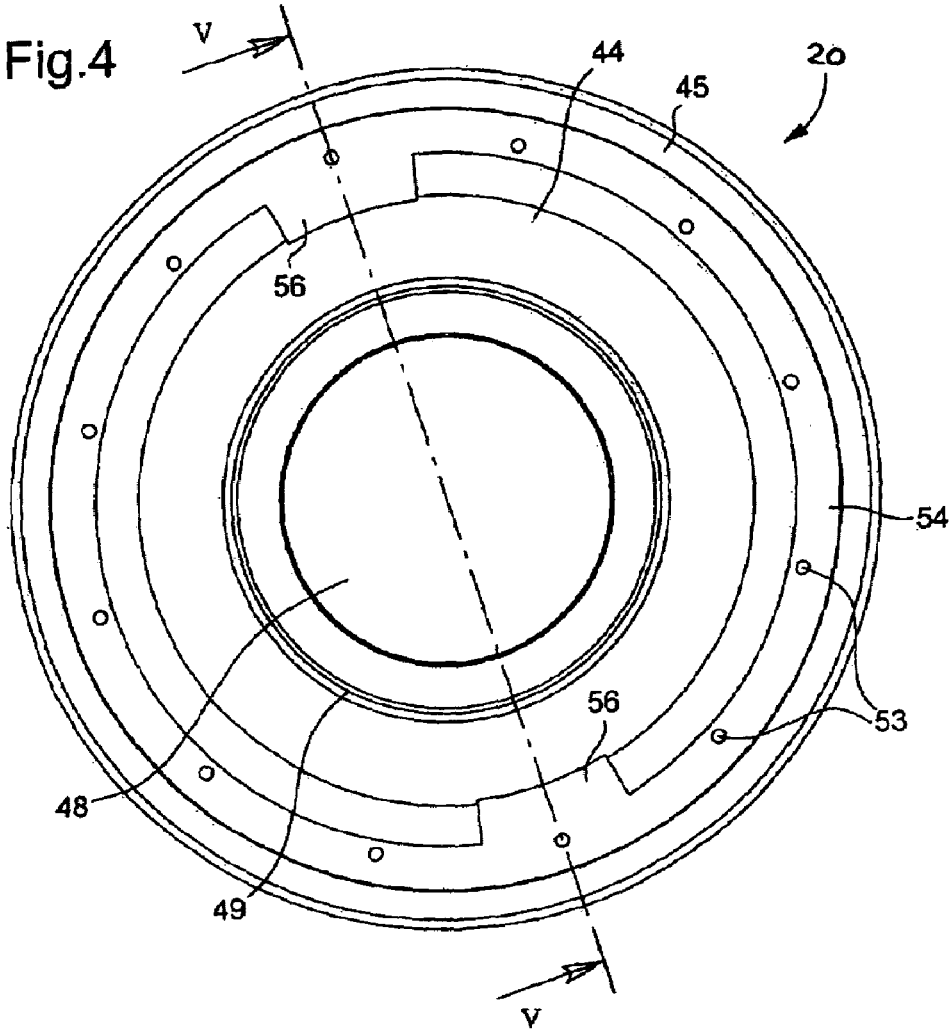
FIG. 4 is a plan view of the inner face of the cover.
Figure 5:
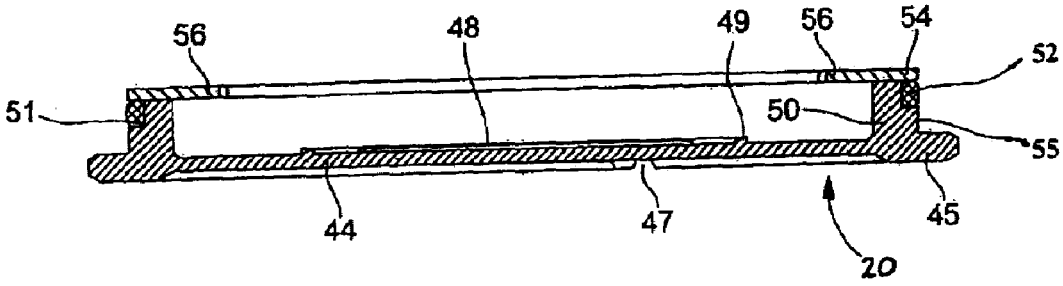
FIG. 5 is a cross-section of the cover along the line V—V of FIG. 4.
Figure 6:
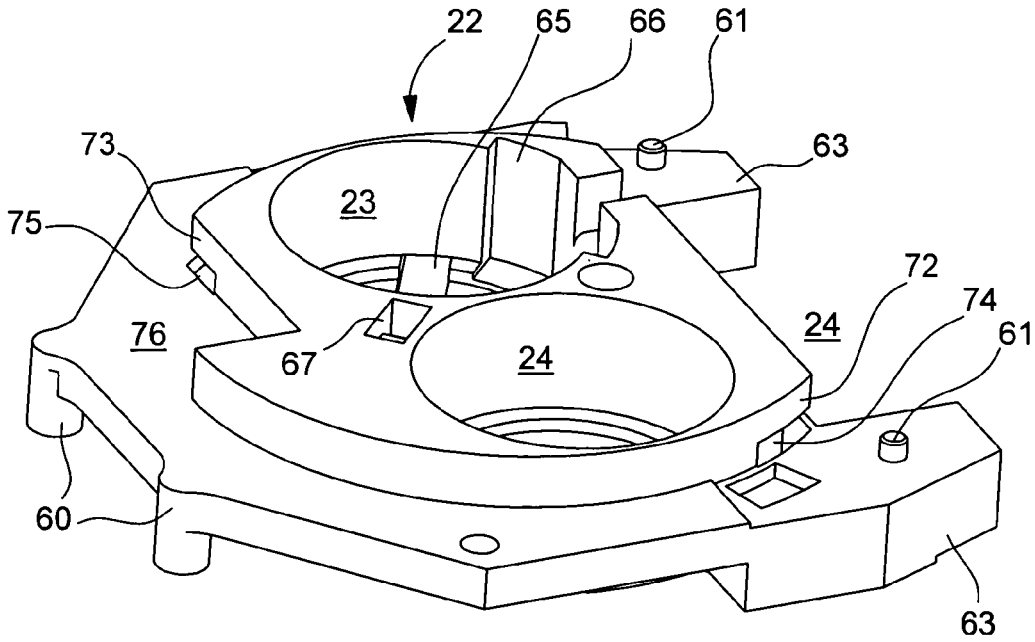
FIG. 6 is a perspective bottom view of a battery support visible in FIGS. 3 and 4.

FIGS. 3 and 6 show in more detail the internal structure of the watch and its main components. The details of cover 20 will be described with reference to FIGS. 4 and 5.

FIG. 3 shows that glass 6 of the watch is carried by a bezel in two parts 26 and 27, mounted on the top of middle part 13 with a sealing gasket 28. Under dial 29 of the watch there is the liquid crystal display 7 and an electronic watch movement 30 including, in particular, a quartz resonator 31 and an electric motor 32, which actuates hands 4 and 5. These elements are mounted on a printed circuit board 33, which is fixed in the case by conventional means, including, in particular, a plate 34 made of plastic material, which supports dial 29.

Underneath board 33, there is an additional electronic device 36 mounted on a printed circuit board 37. This additional device can be one of the aforementioned types and can include, for example, one or more integrated circuits 38 and memories 39. It is supplied with electric energy, like all the components mounted on board 33, by the electric battery assembly formed by the two batteries 41 and 42 housed in support 22 and series connected using metal strips integrated in said support, which is made of insulating synthetic material. In order to simplify the drawing, the electric connections between batteries 41 and 42, support 22, board 37 and board 33 are not shown. Of course, separate power sources could be provided, one of the batteries powering the components mounted on board 33 and the other the components mounted on board 37.

Removable cover 20 includes a circular plate 44, which covers all of opening 15 of the back cover of the case and which has a peripheral portion 45 that is thicker than its central portion. This peripheral portion forms an edge, which is applied against flat bottom surface 46 of back cover 14 of the case, when cover 20 is in the closed position. Two notches 47 are arranged in the outer face of peripheral portion 45 to allow a user to rotate the cover manually by means of his nails or a common object such as a key or the buckle of the watch wristband clasp. According to a variant, knurling could be provided as manual gripping means on the peripheral portion of the cover. On the inner face of cover 20, an electro acoustic transducer 48, preferably made up of piezoelectric elements, is bonded to the central portion of plate 44 in order to make it vibrate, to transmit an acoustic and/or tactile signal to the person wearing the watch. A bulge is provided around transducer 48 to improve the vibrating rate of plate 44.

Above its peripheral portion 45, cover 20 includes a substantially cylindrical annular portion 50 whose external face has a groove 51 for receiving an annular sealing gasket 52 formed, in this case, by an elastomeric O-ring joint. In order to reduce friction, this sealing gasket can be made of a self-lubricating material. Groove 51 is closed at the top by a flat metal washer 54, which is welded at points 53 on the top of annular portion 50 of the cover. The exterior diameter of this washer is approximately equal to that of the cylindrical exterior face 55 of annular portion 50. Washer 54 includes two parts that project radially inwards, which are diametrically opposite and form two locking members 56 of the bayonet fitting device of the cover. In the present case, the two locking members 56 are flat and located in the same plane as the rest of washer 54, but in other embodiments they could be inclined or bent in a Z-shape, as required. Moreover, the number of locking members 56 could of course be greater than two.

FIG. 6 shows battery support 22, seen from below. It is a part made moulded from a rigid and insulating synthetic material, which is held in position inside the watchcase by pressing against back cover 14 and via feet 60 and 61. It can be seen in particular in FIG. 3 that each foot 61 fits into a blind hole 62 in the back cover of the case. It can also be seen that this foot is secured to a projecting portion 63 of the support, which clamps one of the contact strips 64 that guarantee the connection between the battery assembly and the electric circuits of the watch. Other strips of this type are housed in appropriate recesses of support 22, particularly those bearing the references 65 to 67 in FIG. 6. Recess 67 contains one or more strips connecting transducer 48 to its control circuit.

Support 22 is also used to hold removable cover 20 in place and includes for this purpose the fixed elements of the bayonet fitting device. These elements include two shoulders 70 and 71 located on the top face of two edges 72 and 73 of support 22, which are directed outwards. In plane shoulders 70 and 71 have the shape of an arc of a circle of short length and they can be slightly inclined longitudinally in order to pull the cover towards the inside of the case. Above these shoulders there are respective notches 74 and 75 into which locking members 56 of cover 20 can pass.

In FIG. 6, it can be seen that the fixed elements 72 to 75 of the bayonet fitting device, as well as free spaces 76 and 77 allowing locking members 56 to pass in an axial direction when cover 20 is inserted in the case, are all located at places that are not occupied by the battery assembly formed by the batteries occupying recesses 23 and 24. Referring to FIG. 2, it will be observed that these elements are still located inside a circle 80 circumscribed around the battery assembly when the latter is seen in plan. In practice, advantage is taken of the fact that the battery assembly does not have a circular shape and thus leaves unoccupied zones inside the circumscribed circle 80. The same advantage could be achieved, for example, if a single battery or accumulator forming the battery assembly had a square or rectangular shape in plane.

It should be noted that FIG. 3 does not show the maximum width of the battery assembly, since the plane of this cross-section is oblique with respect to that passing through the centres of the two battery housings 23 and 24. In fact, each battery extends up to a small distance from annular portion 50 of the cover.

This advantageously means that the diameter of opening 15 has to be only a little bit bigger than that of circumscribed circle 80, sufficient to allow the thickness of cylindrical annular portion 50 of the cover to pass. Since, moreover, the external edge of the cover does not need to protrude from the periphery of opening 15 by much, the latter can thus be as large as possible, taking account of the dimensions of back cover 14 of the case, and thus provide access to a large-sized battery assembly.

Arranged in this way, cover 20 ensures excellent water-resistance for the back cover of the case in any circumstances. At the moment when it is axially inserted into opening 15, flared entry 81 of the latter gradually compresses the elastomeric sealing gasket 52, which is then permanently radially compressed between annular portion 50 of the cover and fixed cylindrical surface 16 even before the cover is completely pushed into the case. While the cover is then being rotated to engage locking members 56 on shoulders 80 and 71, which will pull the cover until its edge is pressed against the bottom face 46 of the back cover, the water-resistance conditions do not change and the compression of sealing gasket 52 does not induce any stress on locking members 56, or on support 22. Evidently, the same is true when during the operation to remove the cover.

Figure 7:
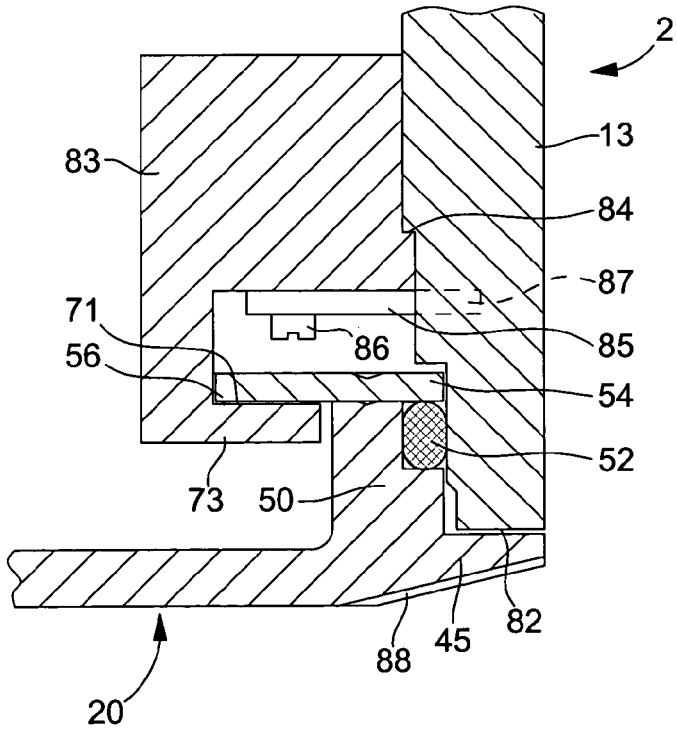
FIG. 7 is a partial vertical cross-section of another embodiment, wherein all of the back cover of the watchcase is removable.

FIG. 7 shows schematically an embodiment of a watch wherein removable cover 20 totally forms the back cover of the watchcase, its peripheral portion 45 covering bottom face 82 of middle part 13 and being applied against the latter via the effect of the bayonet fitting device of the cover. Inner locking members 56 of the cover catch on any fixed support 83 mounted inside the case, each pressing on a shoulder 71 of an edge 73 of the support as in the preceding example. Support 83 is held stopped against a shoulder 84 of the middle part, for example by conventional flat clamps 85, each of which is fixed onto a lower surface of the support by a screw 86 and engaged in a notch 87 of middle part 13. Clamps 85 are preferably located in a different place to catching members 71 and 73 of the bayonet fitting device. Support 83 is not necessarily a battery support, but could be formed, for example, by a plate of a watch movement or by a container made of moulded synthetic material, which contains such a movement. It could also constitute a casing ring carrying the movement in case 2.

In the example of FIG. 7, elements 50, 52 and 54 of back cover 20 are similar to those in the example of FIGS. 2 to 6, but evidently have a larger diameter. However, notches 47 of the preceding example are replaced by knurling 88 on the lower face of peripheral portion 45, to act as manual gripping means allowing the user to open and close the cover without any tools.

It will be noted finally, that the principles of the constructions described hereinbefore can be applied both to metal watchcases and to cases made of other materials, particularly ceramic or synthetic materials.

What is claimed is:

1. A watch having a case which contains an electronic watch movement and an electric battery assembly including at least one battery or at least one accumulator, the case having a circular bottom opening which allows the battery assembly to be inserted and removed and which is closed in a water-resistant manner by a removable cover provided with bayonet fitting means, said cover including a plate, which covers one or more housings for the battery assembly and forms at least a part of a back cover of the case, and a substantially cylindrical annular portion, which extends perpendicularly to said plate and fits into said opening, said annular portion carrying at least two locking members forming part of the bayonet fitting means, wherein a support fixedly mounted in the case houses said battery assembly and extends at least partially facing said opening, wherein said support has shoulders, and wherein said locking members of the cover extend towards a symmetry axis of said annular portion, substantially parallel to said plate, of the cover and catch on said shoulders of said support.

2. The watch of claim 1, wherein an annular sealing gasket is arranged around said annular portion of the cover and, when the cover is secured to the case, is applied radially against a circular surface forming the periphery of said opening.

3. The watch of claim 2, wherein said circular surface is substantially cylindrical and said opening includes a flared entry to ensure radial compression of the sealing gasket when the cover is being set in place.

4. The watch of claim 1, wherein said locking members form part of a metal washer arranged and secured to the top of said annular portion of the cover.

5. The watch of claim 1, wherein the electric battery assembly has a non-circular shape in plane and said shoulders are located between the battery assembly and a circle circumscribed around said non-circular shape.

6. The watch of claim 5, wherein the electric battery assembly includes at least two batteries or accumulators.

7. The watch of claim 1, wherein said fixed support is provided with one or more housings for the electric battery assembly.

8. The watch of claim 7, wherein said support is made of an insulating material.

9. The watch of claim 8, wherein an electro-acoustic transducer is arranged on an inner face of the cover and powered via at least one conductor arranged in said support.

10. The watch of claim 1, wherein the cover forms the entire back cover of the case.

11. The watch of claim 1, wherein gripping means are arranged on a peripheral portion of the cover so as to allow a user to manoeuvre the cover manually without any specific tools.

* * * * *